United States Patent [19]

Bierwirth et al.

[11] Patent Number: 4,566,369

[45] Date of Patent: Jan. 28, 1986

[54] LOADING TRAY MECHANISM FOR A TANK CANNON

[75] Inventors: Adolf P. Bierwirth, Kaarst; Erich Zielinski, Haan, both of Fed. Rep. of Germany

[73] Assignee: Rheinmetall GmbH, Duesseldorf, Fed. Rep. of Germany

[21] Appl. No.: 580,534

[22] Filed: Feb. 15, 1984

[30] Foreign Application Priority Data

Feb. 28, 1983 [DE] Fed. Rep. of Germany ..... 3306935

[51] Int. Cl.[4] ..... F41F 9/06

[52] U.S. Cl. ..... 89/45

[58] Field of Search ..... 89/45, 46, 47

[56] References Cited

U.S. PATENT DOCUMENTS 697,126 4/1902 Becker ..... 89/45

2,851,928 9/1958 Hultgren et al. ..... 89/45

*Primary Examiner*—Stephen C. Bentley

[57] ABSTRACT

A compact loading tray mechanism for loading an ammunition into a gun barrel weapon, preferably a tank cannon. The loading tray mechanism operates so as to prevent an impacting of the cartridge on the rear edge of the loading chamber of the weapon. A first lower loading tray is pivotally mounted on a first pivot arm at one of its ends which first pivot arm is in turn pivotally mounted on a non-recoiling part of the weapon at the other of its ends. A second upper loading tray is fixedly mounted on a second pivot arm at one of its ends which second pivot arm is in turn pivotally mounted at its other end on a non-recoiling part of the weapon. A crank drive is operatively connected to the first and second pivot arms for jointly pivoting them transversely relative to the longitudinal axis of the gun barrel into a loading position in which the respective first and second loading trays form a quasi-extension of the gun barrel which extension forms a cylindrical passage whose internal diameter corresponds to the outer diameter of cartridge bottom. The crank drive also pivots jointly the first and second pivot arms into a folded down position which transversely laterally removed from their loading position.

6 Claims, 4 Drawing Figures

LOADING TRAY MECHANISM FOR A TANK CANNON

BACKGROUND OF THE INVENTION

The invention relates to a loading tray mechanism for a cannon, in particular a tank cannon.

The state of the art is exemplified by a loading mechanism for a non-automatic gun as disclosed in U.S. Pat. No. 2,851,928. In such a known arrangement the tray is movable in a vertical plane by means of a linkage system from a position coaxial with the gun barrel axis to a position above the gun barrel. The arrangement of the aforesaid patent is designed to provide a rapid firing sequence.

However, this known arrangement is not suitable to operate in a limited space, for example when such a cannon is incorporated into a tank, because it is much too space-consuming. Therefore this arrangement cannot be installed in a tank.

Moreover, it is not possible with this known arrangement to bridge-over the space between the load tray and the load chamber of the weapon so as to eliminate any possibility of damaging the cartridge during the loading process, in particular when loading ammunition having a combustible cartridge casing.

SUMMARY OF THE INVENTION

It is an object of this invention to provide an auxiliary loading mechanism for a cannon, particularly a tank cannon, which can operate in a very limited space and in addition to that prevents an impacting of the projectile on the rear edge of the loading chamber.

The tray loading mechanism of the invention is designed to avoid damaging the projectiles during a plural loading and permits an automatic loading process.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
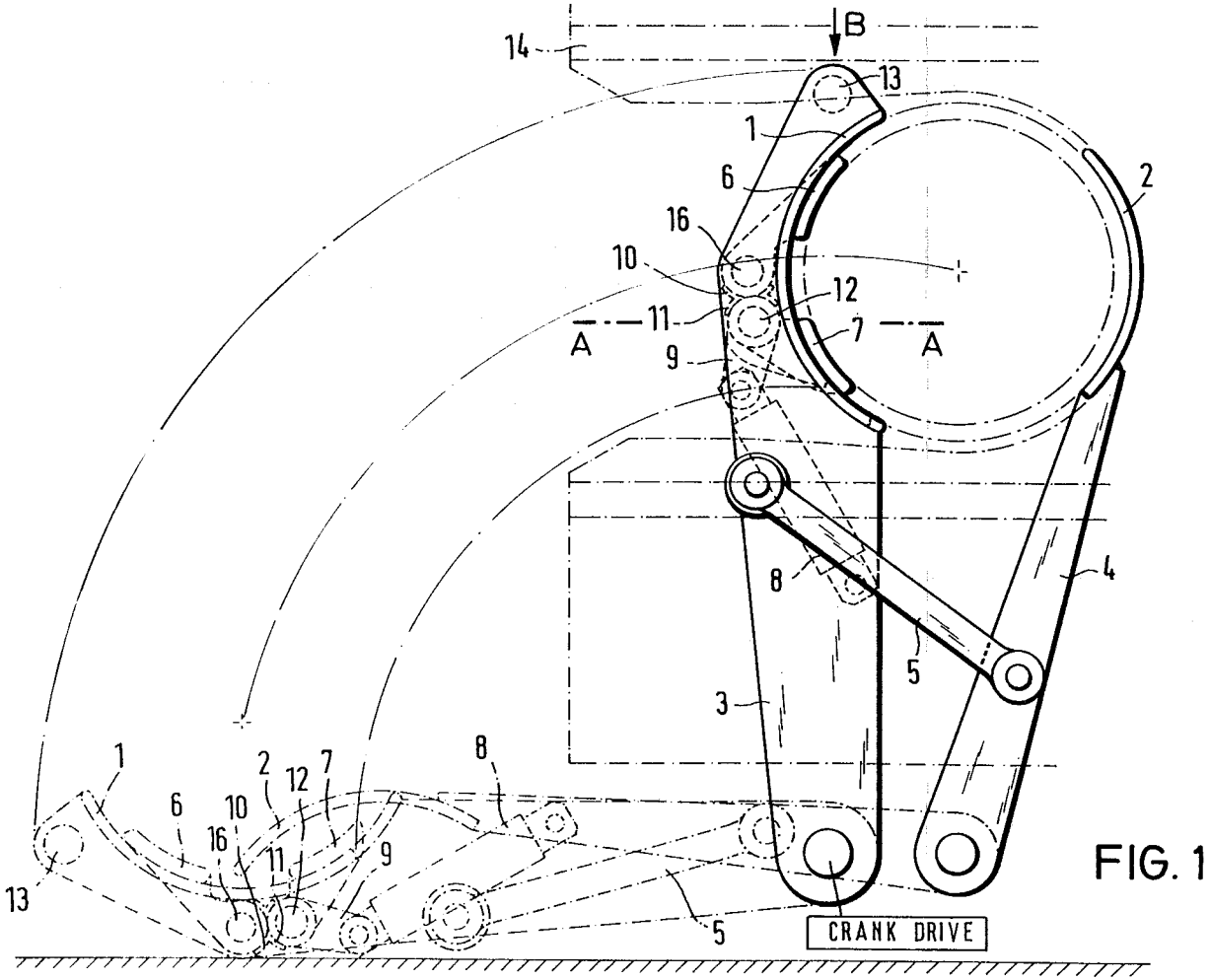
FIG. 1 is an elevational view of the rear end of a gun barrel illustrating the loading tray mechanism of the invention in both swing positions.

The novel loading tray mechanism of the invention is illustrated in detail in FIG. 1. This arrangement includes a loading tray 1 and an upper tray 2 which are respectively secured to two swing arms 3 and 4 which are capable of swinging the projectile laterally with respect to the longitudinal axis of the gun barrel so as to position the projectile parallel to the longitudinal axis of the gun barrel. Both trays 1 and 2 are joined to each other via the swing arms 3 and 4 by means of a linkage 5 pivotally connected to both swing arms 3 and 4, so that when the swing arms 3 and 4 are swung laterally into their starting position they in effect fold into each other (see FIG. 1), whereas when they are in their operative loading position they form an extension of the loading barrel whose size corresponds to that of the exterior diameter of the projectile cartridge. The swing motion is effected by means of a non-illustrated conventional crank drive via the swing arm 3 of the loading tray 1.

At the side of the loading tray 1 which confronts the loading chamber there are arranged two outwardly pivotable shaped parts 6 and 7 which correspond, at the side confronting the loading tray 1, to the diameter of the loading tray and on the other side to the diameter of the loading chamber.

The shaped parts 7, 6 are driven via a pair of gear wheels 10, 11 which are respectively arranged on shafts 12, 16 below the loading tray 1 by means of a hydraulic piston-cylinder 8. In order to transfer the swing movement from the hydraulic piston-cylinder 8 onto the gear wheel 11 there is provided a linkage 9 between both parts.

Figure 2:
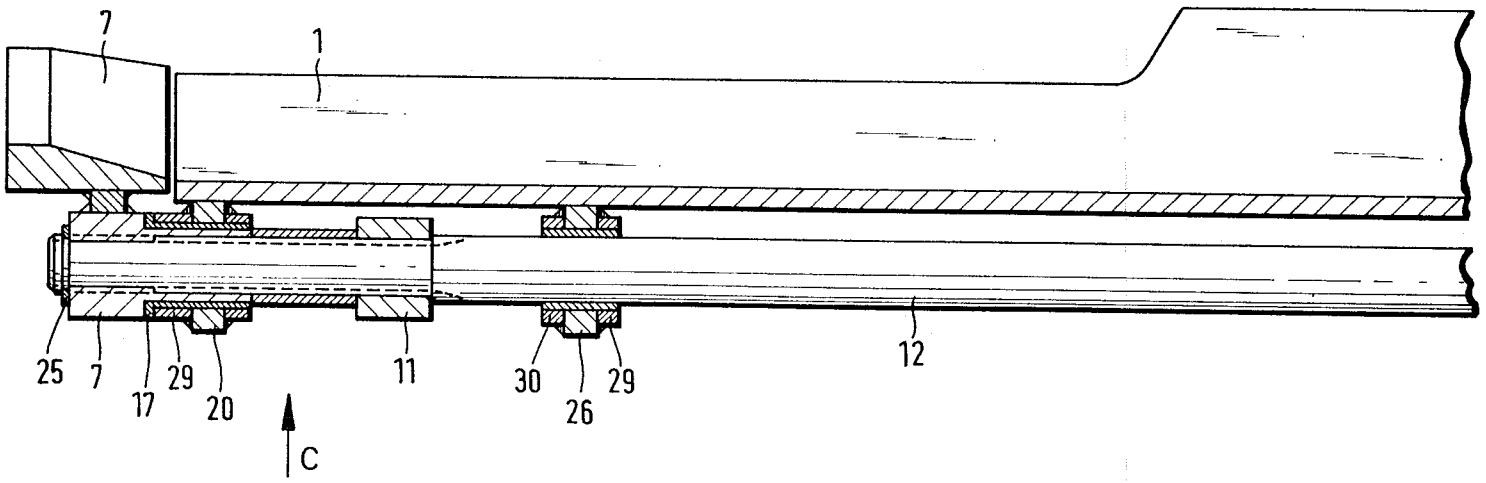
FIG. 2 is a longitudinal sectional view through a loading tray in the direction of arrow B and the supporting shaft along line A—A of FIG. 1.

FIG. 2 illustrates two ribs 20, 26 arranged below the loading tray 1, which ribs are mounted on the shaft 12, which is swingable via the gear wheel 11. The shaft 12 is rotatably mounted within the bearings 29 one of which is disposed between the bushings 7 and 11. The shaped parts 6, 7 are secured on the shafts 12, 16 by means of clamping rings 25.

Figure 3:
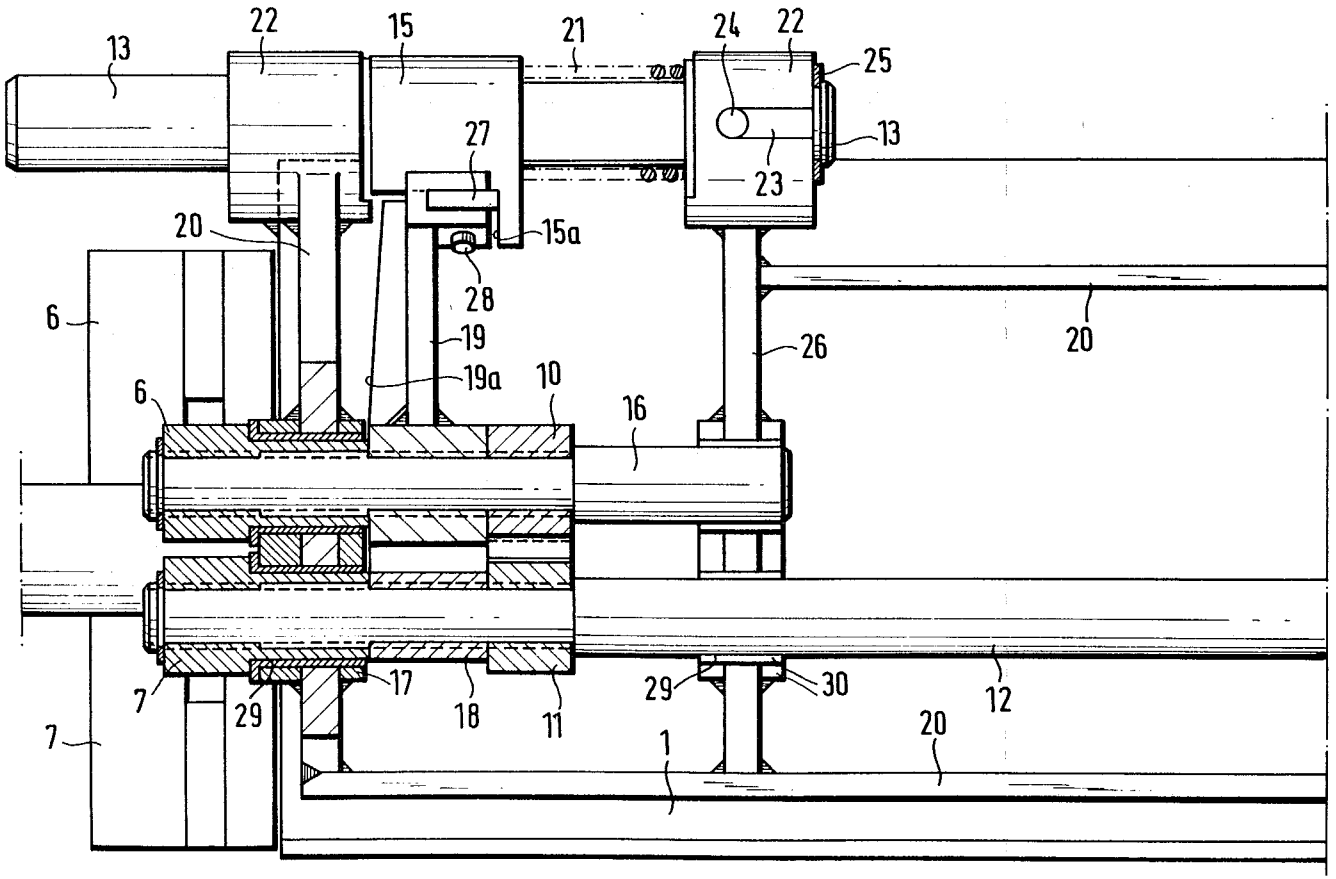
FIG. 3 is a plan view from below partially in cross-section of the loading tray, shaped parts and locking bolts in the direction of the arrow C in FIG. 2.
Figure 4:
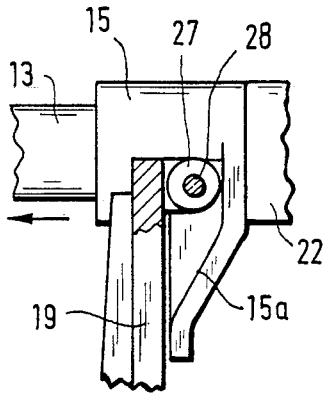
FIG. 4 is a partial side elevational view of the roller 27, the curved piece 15, the locking bolt 13 in a position shifted 90° from the position shown in FIG. 3.

FIG. 3 illustrates in addition to the shaft 12 a further shaft 16 for the shaped part 6 which is also mounted in the ribs 20, 26 on the loading tray 1. Two bushing bearings 22 depend from the ribs 20, 26 for supporting the locking bolt 13. The curved piece 15 is rigidly secured to the locking bolt 13. A coil spring 21 is mounted about the locking bolt 13 between the curved piece 15 and the right bushing bearing 22. The locking bolt 13 is held in the right bushing bearing 22 by means of a clamp ring 25. This locking bolt 13 has a projecting pin 24 which engages in a groove 23 of the right bushing bearing 22 to secure the locking bolt 13 against rotation in the bushing bearing. A roller lever 19 is mounted on the shaft 16 by means of a reinforcing rib 19*a*. The roller lever 19 has one of its free ends shaped as a fork. The roller 27 is disposed between the two shanks of the fork (FIG. 4) and this roller is rotatably mounted on a bolt 28 and bears against the curved surface 15*a* of the curved piece 15. The curve of the curved piece 15 is so shaped that, when pivoting the shaft 16 from the locked position illustrated in FIG. 3, the roller 27 of the curved piece 15 pushes towards the right against the force of the spring 21 and thereby moves also the locking bolt 13 towards the right out of the opening in the bottom member 14. The spacing bushing 18 is disposed on the shaft 12 between the gear wheel 11 and the shaped part 7.

MANNER OF OPERATION

The loadng tray mechanism of this invention operates as follows:

Via a non-illustrated crank drive which engages the swing arm 3 the trays 1 and 2 spread apart from their starting position, which laterally situated adjacent to the gun barrel, to a position in alignment with the gun barrel axis behind the gun barrel. The upper tray 2 is moved by means of the linkage 5, pivotally connected to the swing arms 3 and 4, so far that the loading tray 1 is spaced from the loading tray 2 to align both loading trays with the gun barrel, whose inner diameter corresponds to the largest exterior diameter of the to be inserted cartridge projectile. Thereby this cartridge projectile can be precisely guided on the loading tray. By means of the biased locking bolt 13 arranged in the front portion of the loading tray 1, the latter is, after having been swung into the loading position, locked in an opening in the bottom member 14 in such a way that the gun barrel axis and the axis formed by the passage defined between the trays 1 and 2 coincide during the loading process.

The shaped parts 6 and 7 bridge over, when the loading trays 1 and 2 have been swung into the loading position, the discrepancy in the diameters between the gun barrel and the loading chamber. The to be loaded projectile cartridge slides first, due to the smaller diameter of its casing and the larger diameter of the projectile cartridge bottom, in a skewed position through the passage formed by the trays 1 and 2. By means of the shaped parts 6 and 7 the nose of the projectile is lifted at the forward portion of the casing prior to reaching the loading chamber and is thereby slid into it without damaging it, for example damaging the combustible cartridge casing. After a predetermined length of insertion has been reached the shaped parts swing outwardly, controlled by the gear wheels 10 and 11 and the hydraulic cylinder 8, away from the through-passage diameter of the trays 1 and 2, so that the required through-passage diameter for the cartridge bottom is now made available. Simultaneously with the swinging motion of the shaped parts 6 and 7 the curved piece 15, which is disposed at the locking bolt 13, is slidably displaced via the roller lever 19 which is coupled to the pair of gear wheels 10 and 11 and the coupling with the bottom member 14 is thereby released, since the projectile cartridge has already been sufficiently guided in the loading chamber of the weapon.

During the return swinging motion of the trays 1 and 2 into their starting position, the upper tray 2 and the loading tray 1 fold into each other via the linkage 5 and the shaped parts 6 and 7 and the locking bolt 13 are return-positioned via the hydraulic piston-cylinder 8 into their starting position.

Although the invention is described and illustrated with reference to a preferred of embodiment thereof, it is to be expressly understood that it is in no way limited to the disclosure of such a preferred embodiment but is capable of numerous modifications within the scope of the appended claims.

We claim:

1. An improved loading tray mechanism for loading a cartridge into a gun barrel of a weapon which is pivotally mounted in said weapon so as to be operatively pivotally movable between a first loading position in alignment with the recoil path of the gun barrel and a second firing position angularly removed from said first position in which said loading tray mechanism is not in said recoil path, the improvement comprising said loading tray mechanism including a first lower loading tray, a first pivot arm pivotally supporting said first loading tray at one of its ends and being pivotally mounted on a non-recoiling part of said weapon at the other of its ends, said first pivot arm pivoting transversely with respect to the longitudinal axis of the gun barrel, a second upper loading tray, a second pivot arm being fixedly connected to said second loading tray at one of its ends and being pivotally connected on a non-recoiling part of said weapon at the other of its ends, said second pivot arm also pivoting transversely with respect to the longitudinal axis of the gun barrel, said lower tray and upper second tray when in said first loadng position jointly defining a gun barrel quasi extension having an internal diameter which corresponds to the exterior diameter of the cartridge bottom, and said lower first and upper second trays when in said second firing position folding into each other.

2. The improved loading tray mechanism for loading a cartridge into a gun barrel of a weapon as set forth in claim 1, wherein said first lower loading tray mechanism includes a pair of shafts which are rotatably mounted on said first pivot arm, each shaft having a shaped part mounted thereon which are respectively swingable about said pair of shafts whose axes are parallel to the longitudinal axis of the gun barrel, the diameter of the curved inner surface defined by said shaped parts increasing in the longitudinal axial direction from the diameter of the loading tray gun barrel quasi extension to the diameter of the loading chamber, whereby as soon as said cartridge bottom during the loading process reaches the shaped parts said shaped parts are swung outwardly from the diameter of the loading tray gun barrel quasi extension; and hydraulic piston cylinder means operatively connected to said pair of shafts for rotating them.

3. The improved loading tray mechanism for loading a cartridge into a gun barrel of a weapon as set forth in claim 2, including a shaft pivotally connected at one of its ends to said first pivot arm and to the second pivot arm at the other of its ends for transferring the pivotal movement of the first pivot arm to the second pivot arm.

4. The improved loading tray mechanism for loading a cartridge into a gun barrel of a weapon as set forth in claim 3, wherein said pair of shafts include a pair of gear wheels respectively coaxially mounted thereon, said pair of gear wheels meshingly engaging each other, and a link fixedly connected to one of said shafts of said pair of shafts and being pivotally connected to said hydraulic piston cylinder means so that said piston cylinder means, when actuated, jointly pivots said shaped parts in a predetermined direction.

5. The improved loading tray mechanism for loading a cartridge into a gun barrel of a weapon as set forth in claim 4, including bushing means rigidly connected to rib means which in turn are rotatably mounted on the one shaft of said pair of shafts which is most remote from said other end of said first pivot arm which is mounted on a non-recoiling part of said weapon, a locking bolt is slidably mounted in said bushing means, biasing means operatively mounted on said bushing means for biasing said locking bolt into a first locking postion to thereby maintain said loading tray mechanism in said first loading position, in which locking position one end of the locking bolt engages in an opening of the bottom member of said gun barrel, said first and second loading tray forming said quasi gun barrel extension which is coaxially aligned with the longitudinal axis of the gun barrel.

6. The improved loading tray mechanism for loading a cartridge into a gun barrel of a weapon as set forth in claim 5, including a cam member affixed to said locking bolt, a fork lever rotatably mounted on the one shaft of said pair of shafts which is most remote from said other end of said first pivot arm, a roller rotatably mounted on the free end of said lever and for selective engagement with said cam member for slidably moving said locking bolt from its locking position to a releasing position against the action of said biasing means.

* * * * *